US008699730B2

(12) United States Patent
Lee et al.

(10) Patent No.: US 8,699,730 B2
(45) Date of Patent: Apr. 15, 2014

(54) ELECTRET LOUDSPEAKER DEVICE

(75) Inventors: Chih-Kung Lee, Taipei (TW); Yu-Chi Chen, Nantou County (TW); Han-Lung Chen, New Taipei (TW); Hsu-Ching Liao, Taichung (TW); Wen-Hsin Hsiao, Taoyuan County (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 13/586,866

(22) Filed: Aug. 16, 2012

(65) Prior Publication Data

US 2013/0044905 A1 Feb. 21, 2013

(30) Foreign Application Priority Data

Aug. 18, 2011 (TW) ..... 100129489 A
Jul. 12, 2012 (TW) ..... 101125127 A

(51) Int. Cl.
*H04R 19/01* (2006.01)

(52) U.S. Cl.
USPC ..... 381/191; 381/356; 381/360; 381/150

(58) Field of Classification Search
USPC ..... 381/150, 191, 337, 351–352, 356–357, 381/360
See application file for complete search history.

(56) References Cited

U.S. PATENT DOCUMENTS

| | | | | |
|---|---|---|---|---|
| 8,139,794 | B2 * | 3/2012 | Chen et al. | 381/150 |
| 8,300,859 | B2 * | 10/2012 | Han et al. | 381/191 |
| 8,369,545 | B2 * | 2/2013 | Lee | 381/191 |
| 2009/0245547 | A1 * | 10/2009 | Lee et al. | 381/191 |
| 2011/0255720 | A1 * | 10/2011 | Kao et al. | 381/191 |
| 2012/0051564 | A1 * | 3/2012 | Liou et al. | 381/191 |

* cited by examiner

*Primary Examiner* — Brian Ensey
*Assistant Examiner* — Sabrina Diaz
(74) *Attorney, Agent, or Firm* — Jianq Chyun IP Office

(57) ABSTRACT

An electret loudspeaker device including a diaphragm, a first perforated electrode and a first spacer is provided. The diaphragm has an electret layer and an electrode layer. The first perforated electrode is stacked on a side of the diaphragm near the electret layer, and has multiple holes. The first spacer is stacked between the diaphragm and the first perforated electrode, and includes a first distribution area and plural second distribution areas. The first distribution area has first openings penetrating through the first spacer, and each first opening has a first opening space volume between the diaphragm and the first perforated electrode. Each second distribution area has second openings penetrating through the first spacer, and each second opening has a second opening space volume between the diaphragm and the first perforated electrode. A difference between the first and the second opening space volumes is greater than 10%.

17 Claims, 6 Drawing Sheets

ELECTRET LOUDSPEAKER DEVICE

CROSS-REFERENCE TO RELATED APPLICATION

This application claims the priority benefits of Taiwan application serial no. 101125127, filed on Jul. 12, 2012, and Taiwan application serial no. 100129489, filed on Aug. 18, 2011. The entirety of each of the above-mentioned patent applications is hereby incorporated by reference herein and made a part of this specification.

BACKGROUND

1. Technical Field

The invention relates to an electret loudspeaker device. Particularly, the invention relates to a design that is capable of shaping a directionality of an emitted sound field of an electret loudspeaker device.

2. Related Art

An electret loudspeaker device uses an electrostatic field of an electret diaphragm to transform audio signals of different potentials coming from an electrode layer into a sound field. FIG. 1A is an exploded view of a conventional electret loudspeaker device. FIG. 1B is a side view of the electret loudspeaker device of FIG. 1A. Referring to FIG. 1A and FIG. 1B, in the conventional electret loudspeaker device 10, a first perforated electrode 12 is driven by an external signal to form a potential variation, so as to drive an electret diaphragm 11 to vibrate and produce a sound wave. In order to form a space between the electret diaphragm 11 and the first perforated electrode 12 so as to maintain a room for the electret diaphragm 11 to vibrate in the electret loudspeaker device, a first spacer 13 is disposed between the electret diaphragm 11 and the first perforated electrode 12. The first spacer 13 has a plurality of first openings 13*a*, and the first openings 13*a* carve out the space between the first perforated electrode 12 and the electret diaphragm 11 forming a plurality of chambers 10*a*, and when the electret diaphragm 11 is driven, it vibrates in the chamber 10*a* to produce a sound wave. Therefore, the electret loudspeaker device 10 is basically a loudspeaker device having a plurality of unit sounding cells arranged in an array with one chamber regarded as one unit.

Since the electret loudspeaker is inherently an array speaker device, as a result of interference from every sound wave coming from unit sounding cell, a sound field emitted from the electret loudspeaker device has inherently great directionality in the far field in nature. Although the loudspeaker with great directionality has some specific uses, the application of the electret loudspeaker device is limited as well. Therefore, design of directionality of the emitted sound field of the electret loudspeaker device is required, which allows the electret loudspeaker device could be designed to accommodate the application scenario and gets wider applications more than high directionality.

SUMMARY

The invention is directed to an electret loudspeaker device, in which an emitted sound field has different directionality.

The invention provides an electret loudspeaker device comprising a diaphragm, a first perforated electrode and a first spacer. All of them are in layer form. The diaphragm comprises an electret layer and an electrode layer. The first perforated electrode is stacked on the electret layer side of the diaphragm with the first spacer inserted in between. The first perforated electrode has a plurality of pores so that the sound wave could be transmitted out through those pores. The first spacer has a plurality of openings penetrating through the first spacer in order to form proper space between the diaphragm and the first perforated electrode. The first spacer includes a first distribution area and a plurality of second distribution areas. The first distribution area has a plurality of first openings penetrating through the first spacer, and each first opening has a first opening space volume between the diaphragm and the first perforated electrode. Each of the second distribution areas has a plurality of second openings penetrating through the first spacer, and each second opening has a second opening space volume between the diaphragm and the first perforated electrode. A difference between the first opening space volume and the second opening space volume is greater than 10%. The first opening space volume and the second opening space volume are between $10^{-9}$-30,000 $cm^3$, and a thickness of the first spacer is between 1 μm-3 cm.

The invention provides an electret loudspeaker device comprising a diaphragm, a first perforated electrode, a first spacer, a second perforated electrode and a second spacer. All of them are in layer form. The diaphragm comprises an electret layer and an electrode layer. The first perforated electrode is stacked on one side of the diaphragm with the first spacer inserted in between. The second perforated electrode is stacked on the other side of the diaphragm with the second space inserted in between. The first perforated electrode and the second perforated electrode have a plurality of pores. The first spacer and the second space have a plurality of openings penetrating through the first spacer and the second spacer in order to from proper spaces between the diaphragm and the first perforated electrode and the second perforated electrode. The first spacer includes a first distribution area and a plurality of second distribution areas, and the second spacer includes a third distribution area and a plurality of fourth distribution areas. The first distribution area has a plurality of first openings penetrating through the first spacer, and each first opening has a first opening space volume between the diaphragm and the first perforated electrode. Each of the second distribution areas has a plurality of second openings penetrating through the first spacer, and each second opening has a second opening space volume between the diaphragm and the first perforated electrode. The third distribution area has a plurality of third openings penetrating through the second spacer, and each third opening has a third opening space volume between the diaphragm and the second perforated electrode. Each of the fourth distribution areas has a plurality of fourth openings penetrating through the second spacer, and each fourth opening has a fourth opening space volume between the diaphragm and the second perforated electrode. A difference between at least one of the first opening space volume, the second opening space volume, the third opening space volume and the fourth opening space volume and the other opening space volumes is greater than 10%. The first opening space volume, the second opening space volume, the third opening space volume and the fourth opening space volume are between $10^{-9}$-30,000 $cm^3$, and a thickness of the first and the second spacers is between 1 μm-3 cm.

In an embodiment of the invention, the second distribution areas are disposed at peripheral area of the first spacer comparing to the first distribution area.

In an embodiment of the invention, the first opening space volume is smaller than the second opening space volume.

In an embodiment of the invention, the first opening space volume is greater than the second opening space volume.

In an embodiment of the invention, a shape of the first openings and the second openings are one of a round, a square, a triangle or a polygon.

In an embodiment of the invention, a material of the electrode layer includes aluminium.

In an embodiment of the invention, a material of the first spacer and the second spacer is an insulation material.

In an embodiment of the invention, an electret layer is made of material selected from a group composed of a fluorinated ethylene propylene (FEP) copolymer, polytetrafluoroethylene (PTFE), polyvinylidene difluoride (PVDF), a compound having two carbon chains and a part of fluorine polymers.

In an embodiment of the invention, the diaphragm comprises one of polycarbonate (PC), polyethylene terephthalate (PET), cyclic olefin copolymer (COC) and polymethyl methacrylate (PMMA) or a combination thereof.

In an embodiment of the invention, the second distribution areas are disposed at peripheral area of the spacer comparing to the first distribution area, and fourth distribution areas are disposed at peripheral area of the second spacer comparing to the third distribution area.

In an embodiment of the invention, the first distribution area is disposed corresponding to the third distribution area, and each of the second distribution areas is disposed corresponding to each of the fourth distribution areas, the first opening space volume is the same to the third opening space volume, and the second opening space volume is the same to the fourth opening space volume.

According to the above descriptions, by adjusting the size of the opening space volumes (the first, second, third and fourth) and the arrangement of the distribution areas (the first, second, third and fourth) on the spacers (the first and the second), the electret loudspeaker device of the invention forms sounding unit cells arranged in a sounding array with different patterns. By designing the sounding array according to sound wave interference principle, one can adjust the directionality of the emitted sound field of the electret loudspeaker device Therefore, the electret loudspeaker device of the invention could be designed to have low directionality and be suitable for usage of a general loudspeaker. Or the electret loudspeaker device of the invention could be designed to have high directionality to a specific direction and be suitable for usage of a specific design.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
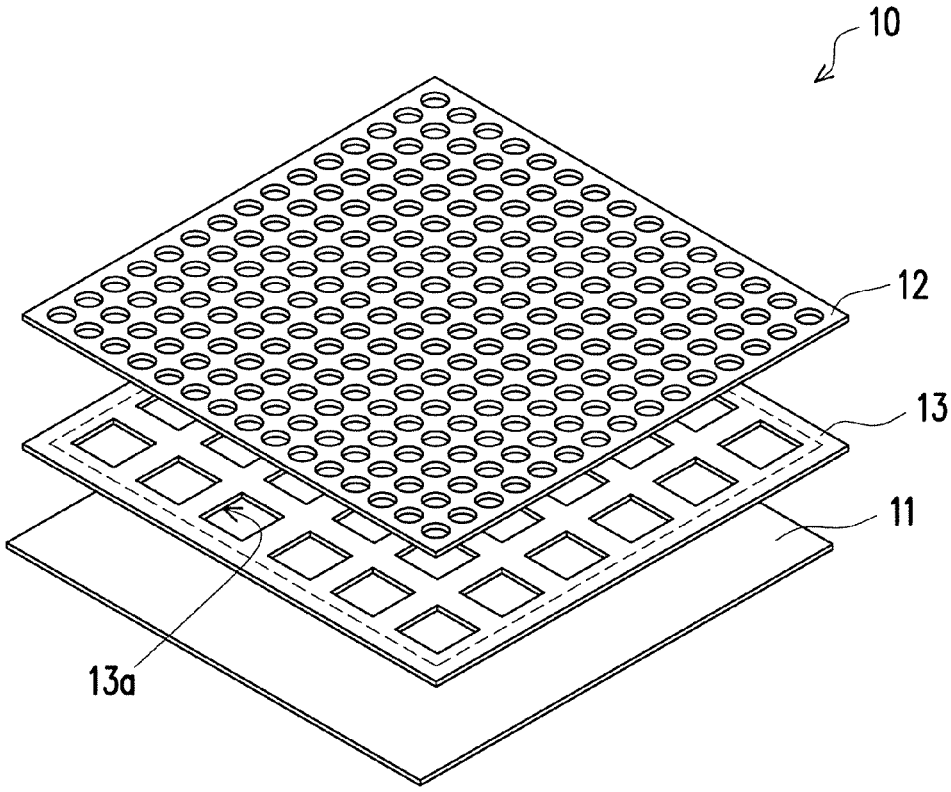
FIG. 1A (PRIOR ART)
FIG. 1A is an exploded view of a conventional electret loudspeaker device.
Figure 1B:
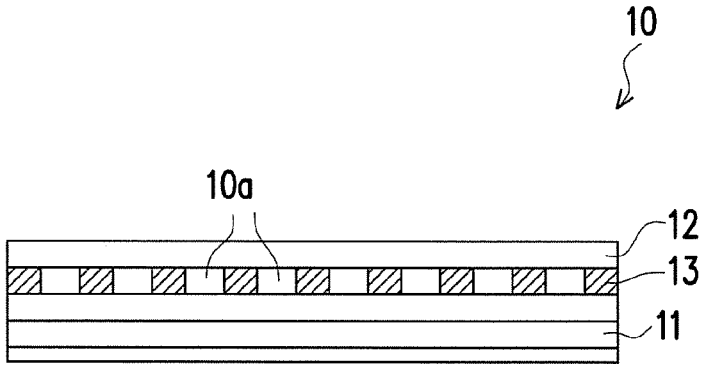
FIG. 1B (PRIOR ART)
FIG. 1B is a side view of the electret loudspeaker device of FIG. 1A.
Figure 2A:
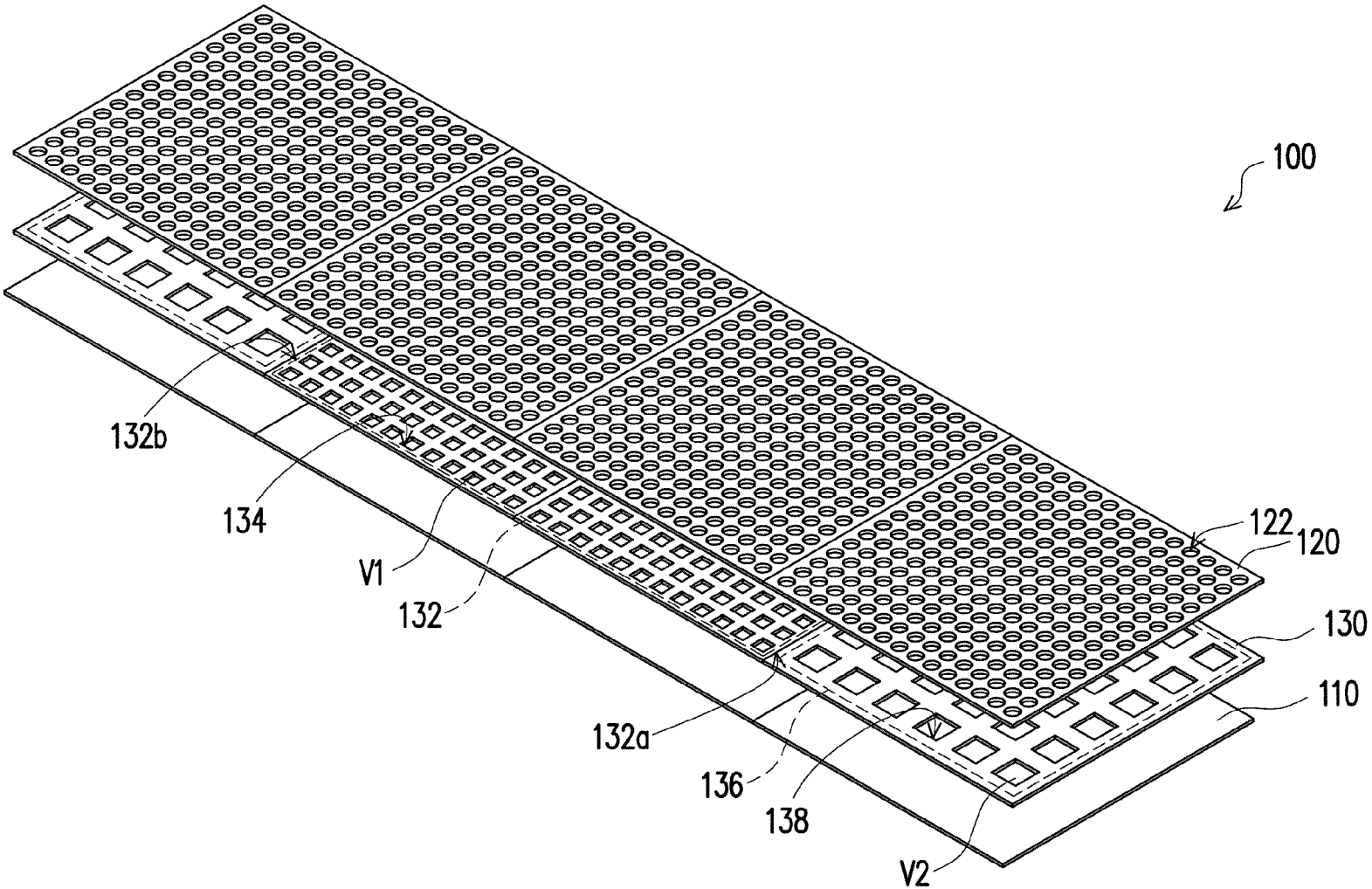
FIG. 2A and FIG. 2B are respectively an exploded view of an electret loudspeaker device and a partial cross-sectional view thereof in a stacked state according to an embodiment of the invention.
Figure 2B:
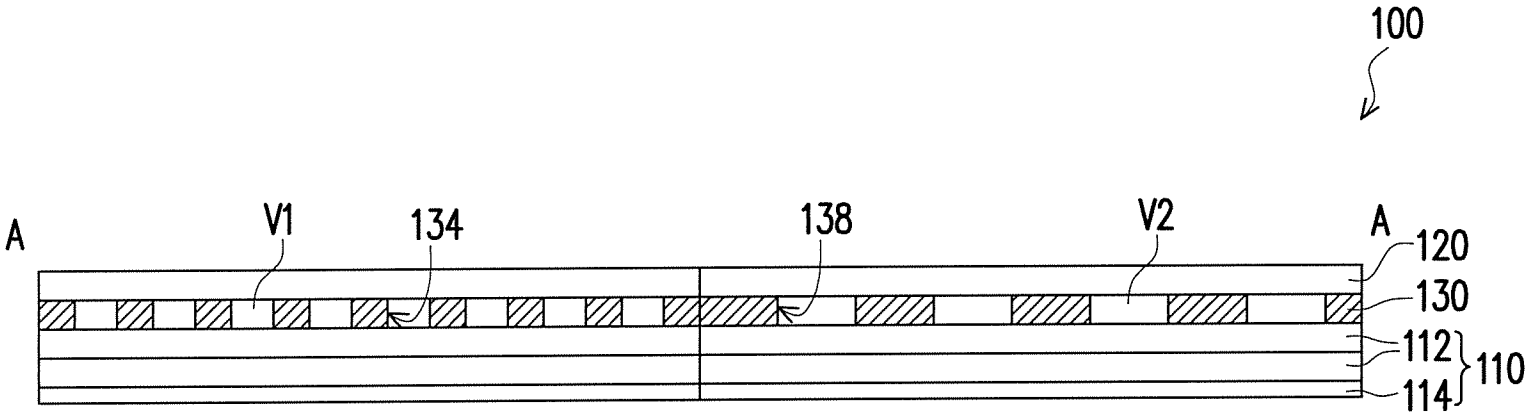
Figure 3A:
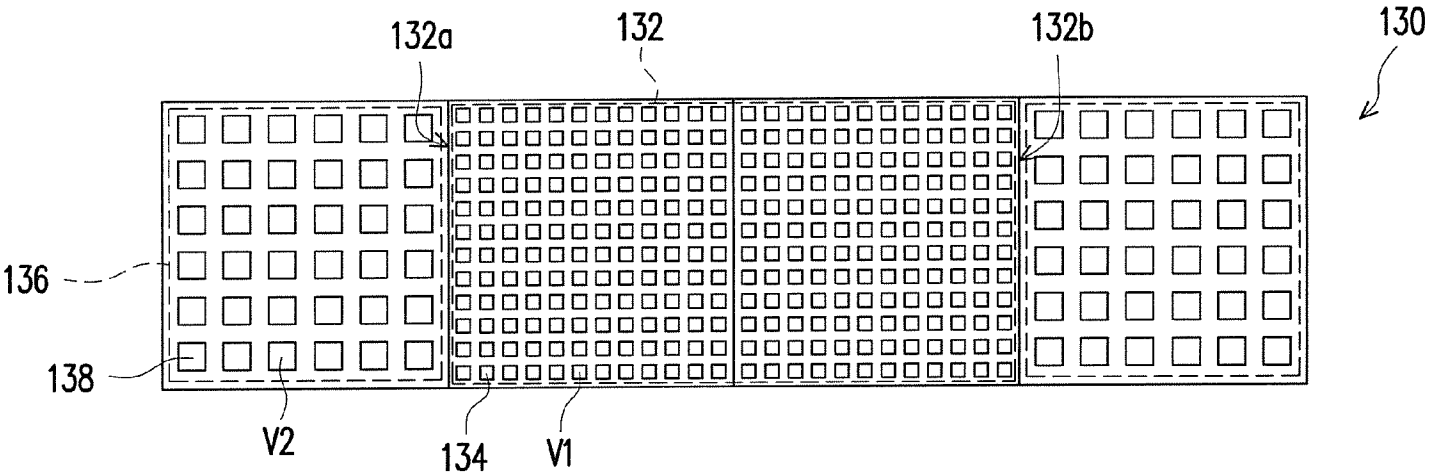
FIG. 3A is a front view of a first spacer of FIG. 2A.

FIG. 2A and FIG. 2B are respectively an exploded view of an electret loudspeaker device and a partial cross-sectional view thereof in a stacked state according to an embodiment of the invention. FIG. 3A is a front view of a first spacer of FIG. 2A. Referring to FIG. 2A, FIG. 2B and FIG. 3A, the electret loudspeaker device 100 comprises a diaphragm 110, a first perforated electrode 120 and a first spacer 130. The diaphragm 110 has an electret layer 112 (for example, a porous electret or a solid electret) and an electrode layer 114. The first perforated electrode 120 is stacked on the electret layer 112 side of the diaphragm 110, and the first perforated electrode 120 has a plurality of pores 122.

The first spacer 130 is stacked between the diaphragm 110 and the first perforated electrode 120, and the first spacer 130 comprises a first distribution area 132 and plural second distribution areas 136. The first distribution area 132 has a plurality of first openings 134 penetrating through the first spacer 130, and each first opening 134 forms a first opening space volume V1 between the diaphragm 110 and the first perforated electrode 120. The second distribution area 136 has a plurality of second openings 138 penetrating through the first spacer 130, and each second opening 138 forms a second opening space volume V2 between the diaphragm 110 and the first perforated electrode 120. A difference between the first opening space volume V1 and the second opening space volume V2 is greater than 10%.

In the present embodiment, the first spacer 130 stacked between the diaphragm 110 and the first perforated electrode 120 has the first openings 134 and the second openings 138 of two different opening space volume distributions, which turns the electret loudspeaker device 100 into a sounding array with each first openings 134 and second openings 138 as a sounding unit cell. By adjusting the opening space volume V1 and V2 and arranging the distribution areas 136 and 138 based on the sound wave interference principles, one can design the directionality of the sound waves emitted by the electret loudspeaker device 100.

In the present embodiment, the second distribution areas 136 are disposed at peripheral areas of the first spacer 130 comparing to the first distribution area 132 in the two opposite sides 132*a* and 132*b* in this case, and the first spacer 130 has a uniform thickness across the first distribution area 132 and the second distribution areas 136. The first opening space volume V1 of the first opening 134 is smaller than the second opening space volume V2 of the second opening 138, therefore, when a sound signal coming from the first perforated electrode 120, vibrating amplitude of the diaphragm 110 in the first distribution area 132 is smaller than the diaphragm 110 in the second distribution area 136. The sound pressure coming from the second distribution areas 136 is greater than the sound pressure coming from the first distribution areas 132, and as an interference result, a wave beam of the sound wave is narrowed in the far field. So that the directionality is enhanced by designing the first spacer 130 this way.

In the aforementioned embodiment, a material of the first spacer 130 is an insulation material with uniform thickness. In another embodiment, the electret loudspeaker device can change the sound pressure by adjusting the thickness of the spacer, so as to achieve an effect of designing the directionality. Thinner thickness between the first perforated electrode 120 and the diaphragm 110 can create larger electrostatic force on the diaphragm 110 while driving and generate larger sound pressure from the area. In other embodiments of the invention that are not illustrated, the first opening has a first thickness, and the second opening has a second thickness, where the first thickness is a multiple (for example, twice) of the second thickness. Such thickness allocation may also achieve the effect of designing the directionality, and the designable thickness variation is between 1 μm-3 cm. However, the invention is not limited thereto.

Figure 3B:
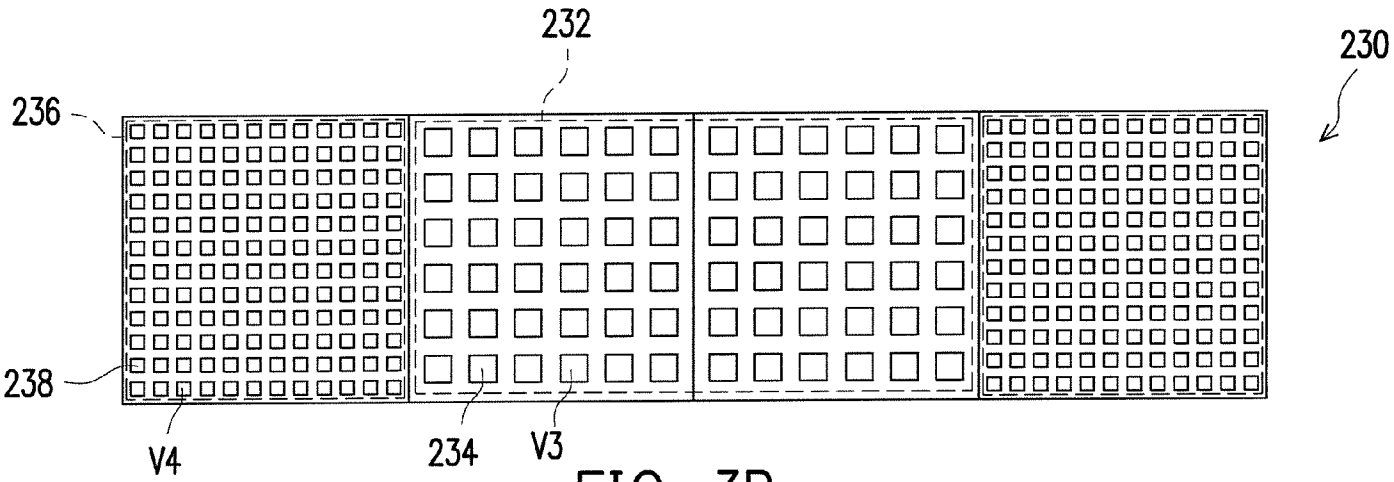
FIG. 3B is a front view of a first spacer according to another embodiment of the invention.

FIG. 3B is a front view of the first spacer according to another embodiment of the invention. In the present embodiment, similar to the embodiment of FIG. 3A, the first spacer 230 of FIG. 3B also has a first distribution area 232 and a second distribution area 236, and a difference there between is that a first opening space volume V3 of a first opening 234 of the first distribution area 232 is greater than a second opening space volume V4 of a second opening 238 of the second distribution area 236, therefore, when a sound signal coming from the first perforated electrode 120, the vibrating amplitude of the diaphragm in the second distribution area 236 is smaller than the diaphragm in the first distribution area 232. Since the sound pressure at peripheral areas is smaller, as an interference result, the wave beam of the sound wave is broadened in the far field, and the directionality is decreased, which has an effect of decreasing the directionality.

In the aforementioned embodiment, the first openings 134 and 234 and the second openings 138 and 238 all penetrate through the first spacers 130 and 230. A shape of the opening can be one of a round, a square, a triangle or a polygon, and these openings can be further arranged in an array. Moreover, the first opening space volumes V1 and V3 and the second opening space volumes V2 and V4 are between $10^{-9}$-30,000 $cm^3$, and a thickness of the first spacer 230 is between 1 μm-3 cm. However, the invention is not limited thereto.

Figure 4A:
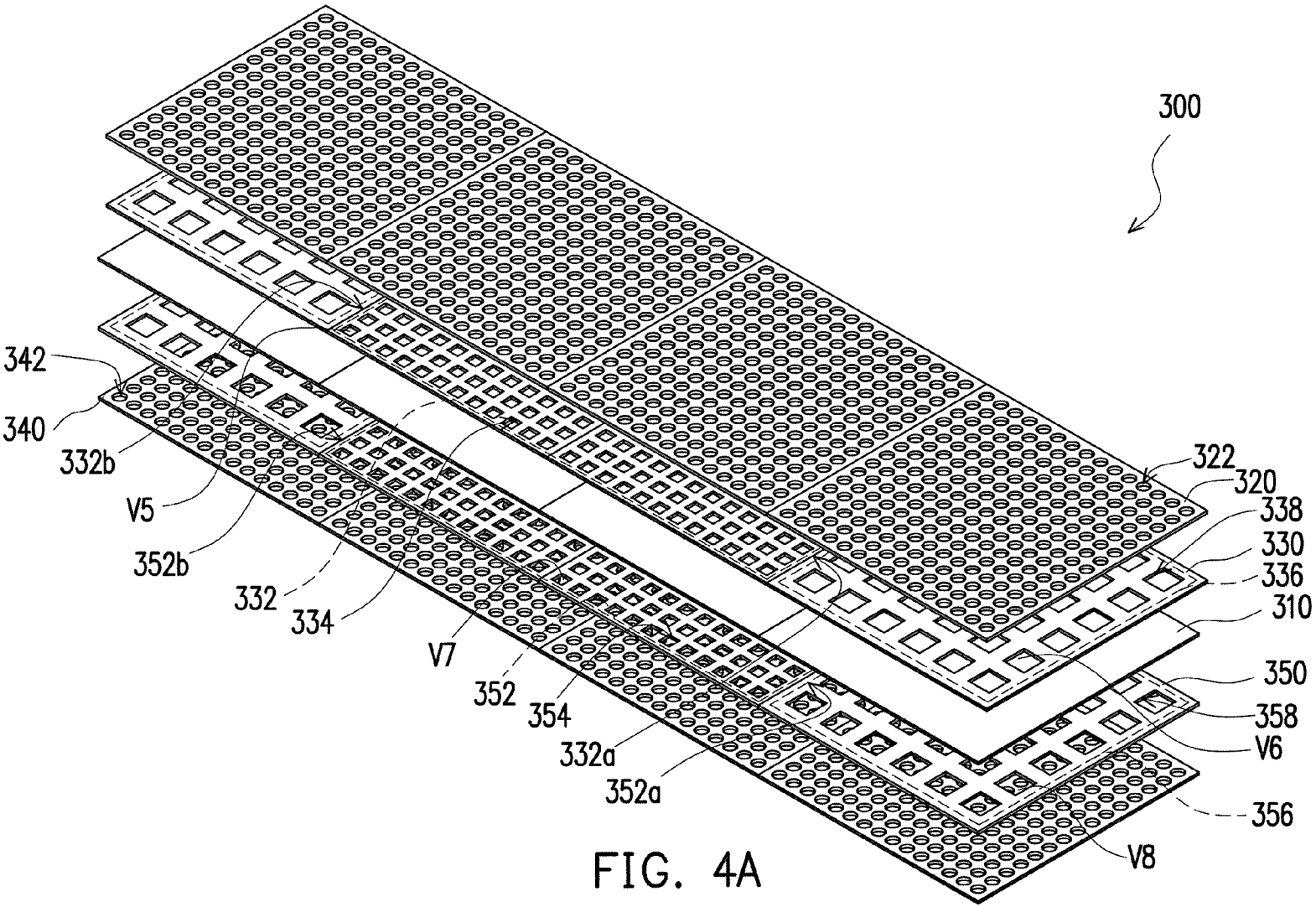
FIG. 4A and FIG. 4B are respectively an exploded view of an electret loudspeaker device and a partial cross-sectional view thereof in a stacked state according to another embodiment of the invention.
Figure 4B:
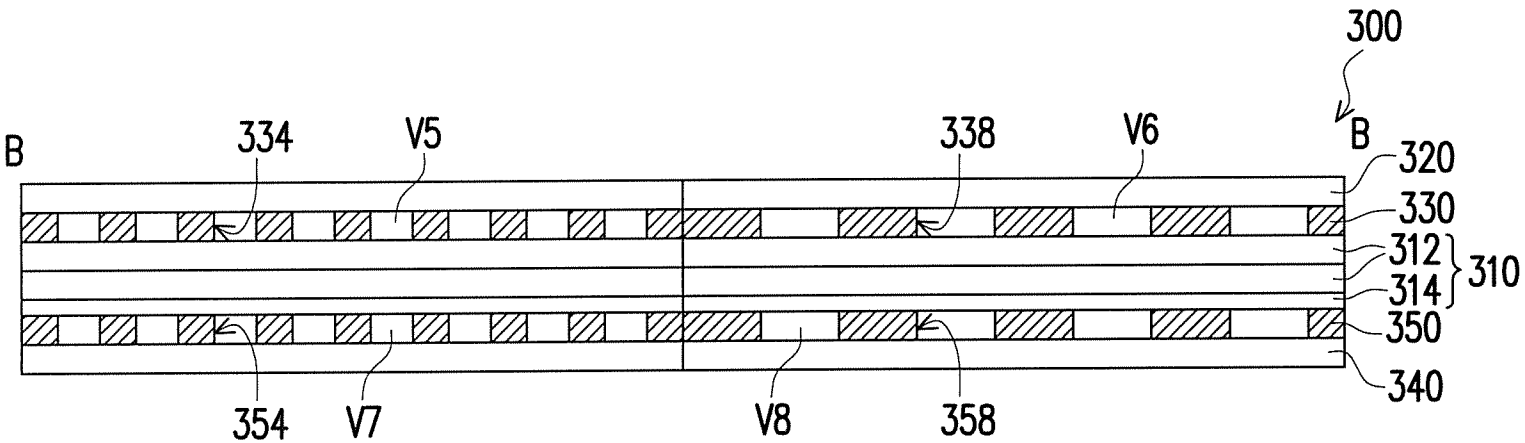

FIG. 4A and FIG. 4B are respectively an exploded view of an electret loudspeaker device and a partial cross-sectional view thereof in a stacked state according to another embodiment of the invention. The electret loudspeaker device 300 of the present embodiment includes a diaphragm 310, a first perforated electrode 320, a first spacer 330, a second perforated electrode 340 and a second spacer 350. The diaphragm 310 has an electret layer 312 and an electrode layer 314. The first perforated electrode 320 and the second perforated electrode 340 have a plurality of pores 322 and 342.

The first spacer 330 is stacked between the diaphragm 310 and the first perforated electrode 320, and the second spacer 350 is stacked between the diaphragm 310 and the second perforated electrode 340. The first spacer 330 includes a first distribution area 332 and plural second distribution areas 336, and the second spacer 350 includes a third distribution area 352 and fourth distribution areas 356. The first distribution area 332 has a plurality of first openings 334 penetrating through the first spacer 330, and each first opening 334 has a first opening space volume V5 between the diaphragm 310 and the first perforated electrode 320. The second distribution area 336 has a plurality of second openings 338 penetrating through the first spacer 330, and each second opening 338 has a second opening space volume V6 between the diaphragm 310 and the first perforated electrode 320. The third distribution area 352 has a plurality of third openings 354 penetrating through the second spacer 350, and each third opening 354 has a third opening space volume V7 between the diaphragm 310 and the second perforated electrode 340. The fourth distribution area 356 has a plurality of fourth openings 358 penetrating through the second spacer 350, and each fourth opening 358 has a fourth opening space volume V8 between the diaphragm 310 and the second perforated electrode 340. A difference between at least one of the first opening space volume V5, the second opening space volume V6, the third opening space volume V7 and the fourth opening space volume V8 and the other opening space volumes is greater than 10%. The first opening space volume V5, the second opening space volume V6, the third opening space volume V7 and the fourth opening space volume V8 are between $10^{-9}$-30,000 $cm^3$, and a thickness of the first spacer 330 and the second spacer 350 is between 1 μm-3 cm.

In the embodiment of FIG. 4A, the second distribution areas 336 of the first spacer 330 are respectively disposed at peripheral areas compared to the first distribution area 332 and is in the two opposite sides 332*a* and 332*b* in this case, and fourth distribution areas 356 of the second spacer 350 are respectively disposed at peripheral areas compared to the forth distribution area 332 and is in the two opposite sides 352*a* and 352*b* in the case. The first distribution area 332 is disposed corresponding to the third distribution area 352, and the second distribution area 336 is disposed corresponding to the fourth distribution area 356. Moreover, the positions of the first opening 334 and the first opening space volume V5 are the same to the positions of the third opening 354 and the third opening space volume V7 respectively, and the positions of the second opening 338 and the second space volume V6 are the same to the positions of the fourth opening 358 and the fourth space volume V8 respectively.

Since the first perforated electrode 320 and the second perforated electrode 340 are respectively disposed at two opposite sides of the diaphragm 310, the electret loudspeaker device 300 of the present embodiment is a dual-driving electret loudspeaker device 300. An advantage of the dual-driving structure is that when the sound signal and the inverted sound signal are electrically connected to the first perforated electrode 320 and the second perforated electrode 340 respectively, attraction and repulsion are both exerted on the diaphragm 310 from opposite directions with equal forces. In this symmetric driving way, a better efficiency on electricity and force transformation can be achieved.

In summary, the electret loudspeaker device of the invention is to configure a plurality of openings penetrating through the spacer that stacked between the diaphragm and the perforated electrode, so as to divide the electret loudspeaker device into a plurality of actuators arranged in an array, and by adjusting a space volume of the spacer opening and an distribution area arrangement thereof, directionality of the emitted sound field of the electret loudspeaker device of the invention can be designed according to an actual requirement. Moreover, a plurality of openings with different opening space volumes can be configured at different areas on a same spacer, and the wave beam of the sound wave can be adjusted by adjusting the opening space volumes of different areas, so as to enhance or decrease the directionality of the electret loudspeaker device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electret loudspeaker device, comprising:

a diaphragm, comprising an electret layer and an electrode layer;

a first perforated electrode, stacked on the electret layer side of the diaphragm, and having a plurality of pores; and a first spacer, stacked between the diaphragm and the first perforated electrode, and comprising a first distribution area and a plurality of second distribution areas, the second distribution areas are disposed at peripheral area of the first spacer comparing to the first distribution area, wherein the first distribution area has a plurality of first openings penetrating through the first spacer, and each first opening has a first opening space volume between the diaphragm and the first perforated electrode, each of the second distribution areas has a plurality of second openings penetrating through the first spacer, and each second opening has a second opening space volume between the diaphragm and the first perforated electrode, and a difference between the first opening space volume and the second opening space volume is greater than 10%, when the first opening space volume is smaller than the second opening space volume, the directionality is enhanced, when first opening volume is greater than the second opening space volume, the directionality is decreased.

2. The electret loudspeaker device as claimed in claim 1, wherein a shape of the first openings and the second openings are one of a round, a square, a triangle or a polygon.

3. The electret loudspeaker device as claimed in claim 1, wherein a material of the electrode layer comprises aluminium.

4. The electret loudspeaker device as claimed in claim 1, wherein the electret layer is made of material selected from a group composed of a fluorinated ethylene propylene (FEP) copolymer, polytetrafluoroethylene (PTFE), polyvinylidene difluoride (PVDF), a compound having two carbon chains and a part of fluorine polymers.

5. The electret loudspeaker device as claimed in claim 1, wherein the diaphragm comprises one of polycarbonate (PC), polyethylene terephthalate (PET), cyclic olefin copolymer (COC) and polymethyl methacrylate (PMMA) or a combination thereof.

6. The electret loudspeaker device as claimed in claim 1, wherein the first opening space volume and the second opening space volume are between $10^{-9}$-30,000 $cm^3$.

7. The electret loudspeaker device as claimed in claim 1, wherein a thickness of the first spacer is between 1 μm-3 cm.

8. The electret loudspeaker device as claimed in claim 1, wherein a material of the first spacer is an insulation material.

9. An electret loudspeaker device, comprising:

a diaphragm, comprising an electret layer and an electrode layer;

a first perforated electrode, stacked on a side of the diaphragm, and having a plurality of pores;

a second perforated electrode, stacked on a side of the diaphragm, and having a plurality of pores;

a first spacer, stacked between the diaphragm and the first perforated electrode, and comprising a first distribution area and a plurality of second distribution areas, the second distribution areas are respectively disposed at peripheral area of the first distribution area, wherein the first distribution area has a plurality of first openings penetrating through the first spacer, and each first opening has a first opening space volume between the diaphragm and the first perforated electrode, each of the second distribution areas has a plurality of second openings penetrating through the first spacer, and each second opening has a second opening space volume between the diaphragm and the first perforated electrode, and a difference between the opening space volume and the second opening space volume is greater than 10%; and a second spacer, stacked between the diaphragm and the second perforated electrode, and comprising a third distribution area and a plurality of fourth distribution areas, the fourth distribution areas are respectively disposed at peripheral area of two opposite sides of the third distribution area, wherein the third distribution area has a plurality of third openings penetrating through the second spacer, and each third opening has a third opening space volume between the diaphragm and the second perforated electrode, each of the fourth distribution areas has a plurality of fourth openings penetrating through the second spacer, and each fourth opening has a fourth opening space volume between the diaphragm and the second perforated electrode, and a difference between at least one of the first opening space volume, the second opening space volume, the third opening space volume and the fourth opening space volume and the other opening space volumes is greater than 10%, when the first opening space volume and the third opening space volume are smaller than the second opening space volume and the fourth opening space volume, the directionality is enhanced, when the first opening space volume and the third opening space volume are greater than the second opening space volume and the fourth opening space volume, the directionality is decreased.

10. The electret loudspeaker device as claimed in claim 9, wherein the first distribution area is disposed corresponding to the third distribution area, and each of the second distribution areas is disposed corresponding to each of the fourth distribution areas, the first opening space volume is the same to the third opening space volume, and the second opening space volume is the same to the fourth opening space volume.

11. The electret loudspeaker device as claimed in claim 9, wherein a shape of the first openings and the second openings are one of a round, a square, a triangle or a polygon.

12. The electret loudspeaker device as claimed in claim 9, wherein a material of the electrode layer comprises aluminium.

13. The electret loudspeaker device as claimed in claim 9, wherein the electret layer is made of material selected from a group composed of a fluorinated ethylene propylene (FEP) copolymer, polytetrafluoroethylene (PTFE), polyvinylidene difluoride (PVDF), a compound having two carbon chains and a part of fluorine polymers.

14. The electret loudspeaker device as claimed in claim 9, wherein the diaphragm comprises one of polycarbonate (PC), polyethylene terephthalate (PET), cyclic olefin copolymer (COC) and polymethyl methacrylate (PMMA) or a combination thereof.

15. The electret loudspeaker device as claimed in claim 9, wherein the first opening space volume, the second opening space volume, the third opening space volume and the fourth opening space volume are between $10^{-9}$-30,000 $cm^3$.

16. The electret loudspeaker device as claimed in claim 9, wherein a thickness of the first spacer and the second spacer is between 1 μm-3 cm.

17. The electret loudspeaker device as claimed in claim 9, wherein a material of the first spacer and the second spacer is an insulation material.

* * * * *